US006283032B1

(12) United States Patent
Wardecki

(10) Patent No.: US 6,283,032 B1
(45) Date of Patent: Sep. 4, 2001

(54) PROJECTILE WITH CONTROLLED DECOMPOSITION AND INTEGRATED CHARGE IN THE AREA OF THE EFFECTIVE MASS

(75) Inventor: Norbert Wardecki, Heuweiler (DE)

(73) Assignee: Buck Neue Technologien GmbH, Schneizlreuth (DE)

( * ) Notice: Subject to any disclaimer, the term of this patent is extended or adjusted under 35 U.S.C. 154(b) by 0 days.

(21) Appl. No.: 09/353,642

(22) Filed: Jul. 15, 1999

(30) Foreign Application Priority Data

Jul. 15, 1998 (DE) ..... 298 12 623 U

(51) Int. Cl.[7] ..... F42B 13/34

(52) U.S. Cl. ..... 102/334; 102/334; 102/364; 102/315; 102/320; 102/321; 102/322; 102/323

(58) Field of Search ..... 102/314, 315, 102/320, 321, 323, 322, 331, 493–495, 499, 529, 364, 334

(56) References Cited

U.S. PATENT DOCUMENTS

| | | | | |
|---|---|---|---|---|
| 1,367,464 | * | 2/1921 | Cook | 102/493 |
| 1,382,750 | * | 6/1921 | Sprague et al. | 102/499 |
| 2,419,371 | * | 4/1947 | Schlumberger | 102/320 |
| 3,358,600 | * | 12/1967 | Griffith et al. | 102/314 |
| 3,517,616 | * | 6/1970 | Martin | 102/323 |
| 4,593,622 | * | 6/1986 | Fibranz | 102/530 |
| 4,622,899 | * | 11/1986 | Weber | 102/334 |
| 5,092,245 | * | 3/1992 | Douglas et al. | 102/324 |
| 5,551,345 | | 9/1996 | Wardecki et al. . | |
| 5,700,971 | | 12/1997 | Rayer et al. . | |

* cited by examiner

*Primary Examiner*—Charles T. Jordan
*Assistant Examiner*—Lulit Semunegus
(74) *Attorney, Agent, or Firm*—Burns, Doane, Swecker & Mathis, LLP

(57) ABSTRACT

A smoke-generating projectile has a decomposable effective mass, the mass including a quick-burning deception component for generating spontaneous smoke, and a slow-burning concealment component for generating persistent smoke. The projectile includes an igniter, an ejection charge and/or ignition decomposition charge and at least one ignition delay device. The projectile is constructed so that the energy of decomposition of at least one of the effective mass components is constrained in a radial direction. The ejection charge and/or the ignition decomposition charge, as well as at least one ignition delay device, is installed in the effective mass.

16 Claims, 2 Drawing Sheets

PROJECTILE WITH CONTROLLED DECOMPOSITION AND INTEGRATED CHARGE IN THE AREA OF THE EFFECTIVE MASS

BACKGROUND OF THE INVENTION

The current invention relates to a projectile with an effective mass, specifically a quick-burning deception component generating spontaneous smoke and a slow-burning concealment component generating persistent smoke, comprising an igniter, ejection charge and/or ignition decomposition charge, and at least one ignition delay device.

Such a projectile, for protecting an object, is known from Wardecki et al. U.S. Pat. No. 5,551,345, for example, the disclosure of which is incorporated by reference herein. A two-component smoke projectile is described therein, whereby the deception component is separated during firing of the concealment component and is accelerated relative to the concealment component and becomes effective at the same time. The separation of the two effective elements and the decomposition action of the deception component causes, however, such an impulse thrust in case of the known two-component smoke projectile and also causes such uncontrollable sequential propulsion that the sequence of decomposition action of the spontaneous smoke (of the deception component) and the persistent smoke (of the concealment component) may not be maintained.

A quick-action smoke hand grenade for an effective charge is known from Rayer et al. U.S. Pat. No. 5,700,971, whereby the person throwing the grenade is protected from mechanical injuries mainly because the more solid small parts of the grenade remain together by means of corresponding safety elements and are not blown away during and after decomposition of the effective charge. The disclosure of this document is incorporated by reference herein.

In addition, a training warhead is known from DE-297 18 216, whereby an electric igniter is installed, at least partly, within the ignition decomposition charge to initiate decomposition in the ignition charge and to cause a reaction in the effective charge essentially without delay. The disclosure of this document is incorporated by reference herein.

Finally, it is known from DE-28 30 119 to install ignition decomposition charges within the effective mass component. The disclosure of this document is incorporated by reference herein.

The invention has the task to develop the generic projectile in such a manner that operating reliability is increased and risk of injury to the person throwing the grenade is minimized while reducing cost and simplifying the design.

SUMMARY OF THE INVENTION

This task is solved, according to the invention, in that at least one effective mass component is exclusively radial decomposable; whereby the bottom of at least one effective mass can (container) is connected firmly with the lid of this can, even during decomposition action of the effective mass; whereby there is installed in the effective mass at least one ignition delay device, the ejection charge and/or decomposition charge; and whereby the igniter is installed, at least partly, within the effective mass.

It is thereby preferred, according to the invention, that the lid of at least one effective mass can is connected with a perforated pipe to the bottom of this can and that the perforated pipe has an ignition decomposition charge.

One innovative version is characterized in that the effective mass includes a deception component and a concealment component, the deception component is exclusively radial decomposable, the deception component is placed in at least one effective mass can that has a firm connection between its lid and it bottom, the concealment component is placed in another effective mass can, both effective mass cans are connected with one another, an ignition delay device of the concealment component and the ejection charge are installed in the concealment component.

Thereby it may be planned that an ignition delay device of the deception component is installed in the concealment component.

It is further suggested, according to the invention, that the preferably electric igniter is installed in the concealment component.

Thereby it may also be planned that the igniter is, at least partly, placed into the ejection charge.

According to the invention, a primer may be installed that extends longitudinally through the center of the concealment component and in which primer there is located the ejection charge and the ignition delay device of the deception component.

It may also be planned that the weight of the individual effective mass particles, which are separated during decomposition action, is minimized.

The invention suggests further that at least one effective mass can, specifically the one for the deception component, has a shell between its bottom and the lid and that this shell is very thin and breaks up into small, light pieces.

In one preferred version it is planned, according to the invention, that the effective mass can (container) of the concealment component has a shell between its bottom and the lid and that the shell of the can would melt during burnout of the concealment component.

Finally it is planned, according to the invention, that the radius of the decomposition throwing range is adjustable by at least one ignition delay device.

The invention is therefore based on the surprising realization that the corresponding decomposition energy is effective only in radial direction at decomposition of the effective mass, so that the effective mass is distributed over a large area during decomposition while no other parts of the projectile receive an impulse from the decomposition that could cause deviation from the ballistic path during flight. In addition, no parts turn into shrapnel, which would have the potential for injuries. For this reason and also to simplify the projectile design at a reduction in cost, according to the invention, the bottom and the lid of the effective mass can (container) are firmly connected to one another, for example, by a perforated pipe that serves as a tie rod. The developing pressure that is pushing during decomposition in longitudinal direction against the bottom and the lid of the can (container) is cancelled out, so that an effective force remains only in radial direction. A considerable reduction in cost is realized in that all charges, the ejection charge, the ignition decomposition charge, and the ignition delay device are installed inside the projectile and whereby the igniter is preferably installed, at least partly, in the ejection charge. This saves space or makes more room for the effective components within the projectile.

A preferred version of the invention is realized in case of two-component smoke projectiles whereby no separation of the effective mass component occurs during decomposition action of a deception component and a concealment component. This results in reduction of injury potential, a better decomposition sequence and cost reduction.

BRIEF DESCRIPTION OF THE DRAWINGS

The objects and advantages of the invention will become apparent from the following detailed description of preferred embodiments thereof in connection with the accompanying drawing, in which like numerals designate like elements, and in which.

DETAILED DESCRIPTION OF PREFERRED EMBODIMENTS OF THE INVENTION

Figure 1:
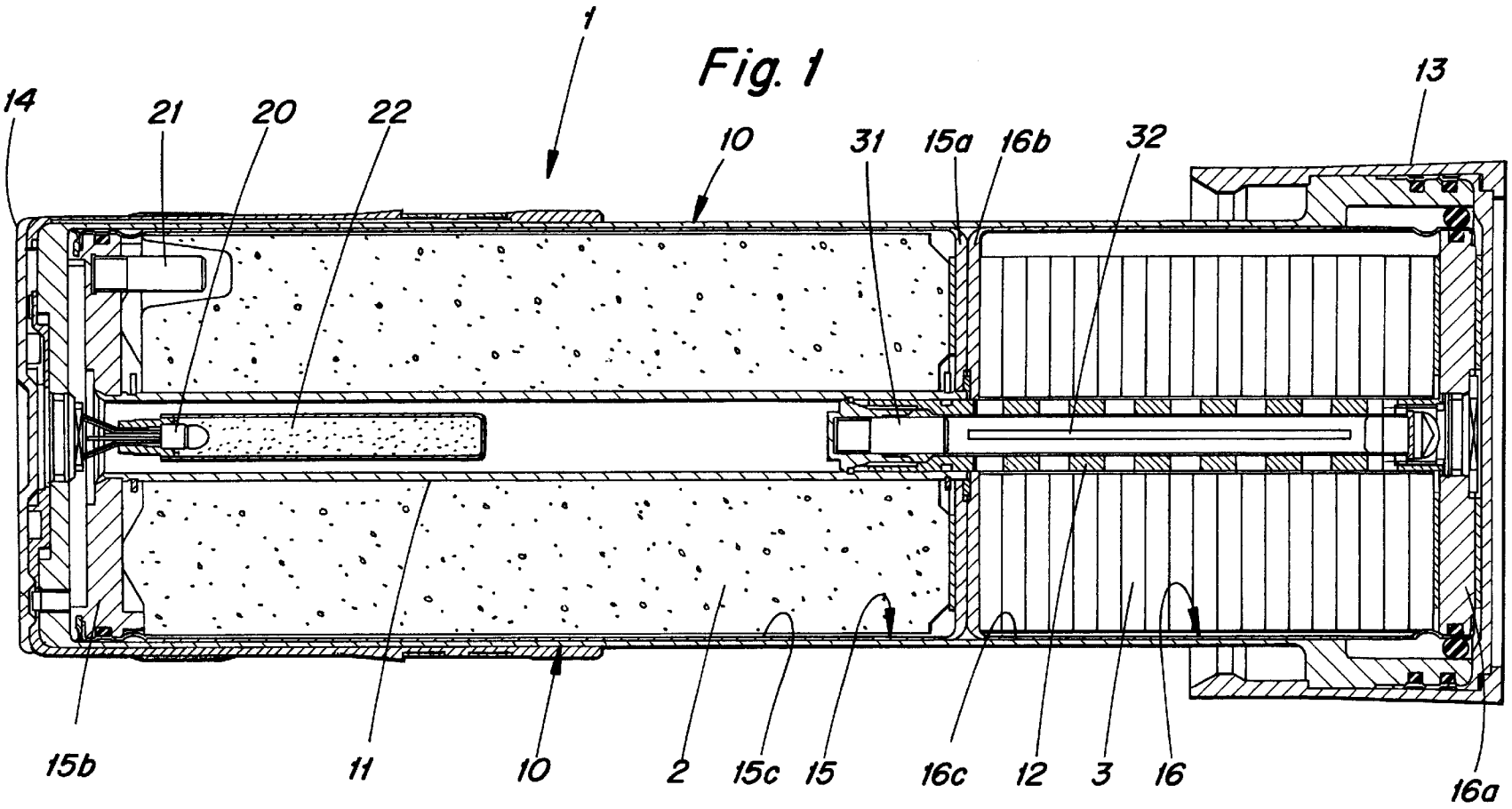
FIG. 1 shows a sectional view of an innovative projectile.
Figure 1A:
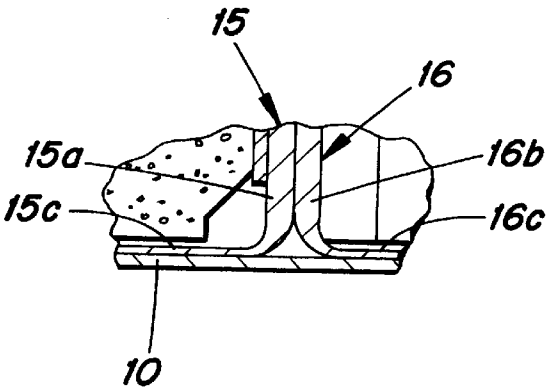
FIG. 1*a* depicts a portion of the projectile where two containers contact one another.

As it can be seen in FIGS. 1 and 1*a*, the innovative projectile 1 includes a shell 10 which contains a concealment component 2, a deception component 3, a primer 11 in the area of the concealment component 2, and a perforated pipe 12 in the area of the deception component 3. The shell 10 is sealed at opposite ends by a lid 13 and a contact cup 14. The deception component 3 and the concealment component 2 are placed in respective first and second containers or cans 16, 15. The container 15 includes longitudinally spaced end walls 15*a*, 15*b* joined by a cylindrical side wall 15*c*.

Likewise, the container 16 has longitudinally spaced end walls 16*a*, 16*b* joined by a cylindrical side wall 16*c*. The end walls 15*a* and 16*b* are affixed together in any suitable manner, whereby the containers 15, 16 together form a unit. Inside the can 15 of the concealment component 2 there is additionally installed, at least partly, an electric igniter 20, an ignition delay device 21 for the concealment component 2, an ejection charge 22, and an ignition delay device 31 for the deception charge 3; whereby an ignition decomposition charge 32 is located in the perforated pipe 12 inside the can 16 of the deception component 3.

The longitudinal connection established by the pipe 12 will keep the end walls 16*a*, 16*b* secured together during decomposition of the deception component 3, but the side wall 16*c* is designed to be destroyed all at once, whereby the decomposition of the deception component 3 will be constrained to occur in a lateral (radial) direction. For example, the side wall could comprise a thin shell-like wall which easily breaks into pieces all at once.

On the other hand, the side wall 15*c* of the container 15 is preferably designed to be gradually destroyed as the decomposition of the concealment component 2 proceeds. For example, the side wall 15*c* could be designed to melt under the heat of decomposition.

Alternatively, the container 15 could be designed to behave like the container 16, i.e., to constrain the decomposition to occur in a radial direction.

Decomposition of the innovative projectile 1 is described in detail below in connection with FIGS. 2*a* to 2*d:*

Figure 2D:
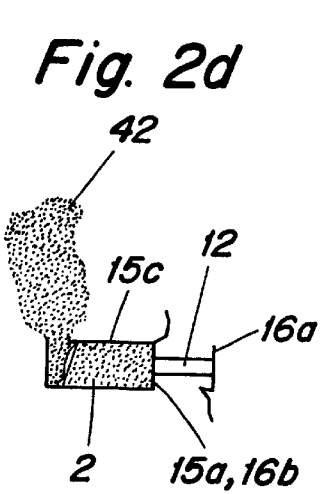
FIGS. 2*a*–2*d* show respective stages of decomposition of the innovative projectile.
Figure 2C:
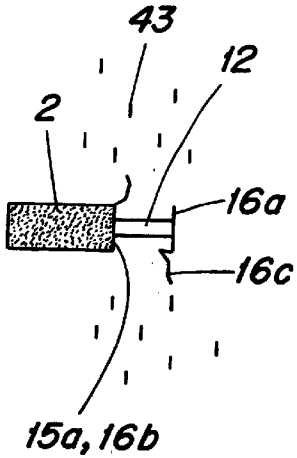
Figure 2B:
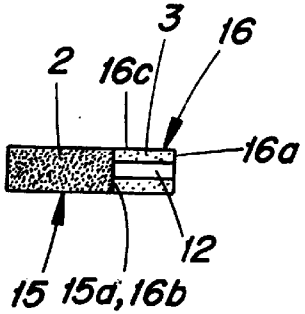
Figure 2A:
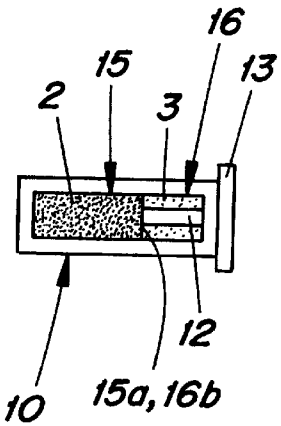

FIG. 2*a* shows the projectile of FIG. 1 in simplified form before being fired from a launching tube (not shown).

By activating the electric igniter 20, the ejection charge 22 is ignited whereby the cans 15, 16 are ejected together as a unit from the shell 10 and from the launching tube, whereby the shell 10, together with the contact cup 14, remains in the launching tube. Thereby only the cans 15 and 16, which are firmly attached to one another, fly along a chosen ballistic path as indicated in FIG. 2*b*.

After a predetermined time period, decomposition action in the deception component 3 occurs, which is caused by the ignition delay device 31 that is also located in the primer 11 together with the ejection charge 22.

Since the side wall 16*c* is designed to break into pieces all at once, whereas the pipe 12 keeps the end walls 16*a*, 16*b* secured together, the energy of decomposition of the deception component 3 will be constrained in a radial direction as shown in FIG. 2*c*.

Thus, the smoke is distributed over a large radial area while producing no longitudinal impulses that could cause the projectile to deviate from the intended flight path. Also, there are no large pieces of shrapnel which could produce serious injuries.

After an additional predetermined time period, the ignition delay device 21 causes burnout decomposition of the concealment component 2 to produce persistent smoke 42 as the side wall 15*c* gradually melts. The time of delay in the ignition delay devices 21 and 31 is selected relative to one another in such a manner that the timed sequence of spontaneous smoke 43 and the persistent smoke 42 causes concealment of the to-be-protected object, which is not shown in the drawing.

Although the invention has been described in connection with preferred embodiments, it will be appreciated by those skilled in the art that additions, modifications, substitutions and deletions not specifically described, may be made without departing from the spirit and scope of the invention as defined in the appended claims.

What is claimed is:

1. In a projectile comprising a decomposable effective mass, an igniter, a decomposition charge, and an ignition delay device, the improvement wherein the effective mass is disposed within a container, and the charge is arranged within the effective mass for producing decomposition thereof, the container comprising longitudinally spaced end walls and a side wall, the end walls being interconnected by a connection separate from the side wall which keeps the end walls interconnected during decomposition of the effective mass, whereby the energy of decomposition is constrained to occur in a lateral direction.

2. The projectile according to claim 1, wherein the connection comprises a pipe extending longitudinally within the effective mass from one of the end walls to the other end wall.

3. The projectile according to claim 2, wherein the pipe is perforated and the charge is disposed within the pipe.

4. The projectile according to claim 1, wherein the side wall is thinner and more easily destructible than the end walls.

5. The projectile according to claim 1, wherein the side wall is of cylindrical cross section.

6. The projectile according to claim 1, wherein the effective mass comprises a smoke-generating effective mass.

7. The projectile according to claim 1, wherein the container constitutes a first container, the effective mass constitutes a first effective mass, and the decomposition charge constitutes a first decomposition charge, the projectile further comprising a second container attached to the first container for remaining attached thereto following launching of the projectile, the second container containing a second decomposable effective mass, and a second decomposition charge disposed in the second effective mass for producing decomposition of the second effective mass.

8. The projectile according to claim 7, wherein the ignition delay device constitutes a first ignition delay device disposed inside of the second effective charge for delaying ignition of the first effective charge following a launching of the projectile, the projectile including a second ignition delay device disposed in the second effective charge for delaying ignition thereof.

9. The projectile according to claim 8, further including an ejection charge disposed inside of the second effective mass for launching the projectile.

10. The projectile according to claim 7, wherein the second container includes a side wall adapted to melt under heat generated by decomposition of the second effective mass.

11. The projectile according to claim 7, wherein the connection of the first container comprises a pipe extending longitudinally within the first effective mass from one end wall to the other end wall.

12. The projectile according to claim 11, wherein the pipe is perforated and the first decomposition charge is disposed inside of the pipe.

13. The projectile according to claim 7, wherein the side wall of the first container is thinner and more easily destructible than the end walls of the first container.

14. The projectile according to claim 7, wherein the second decomposable effective mass comprises a smoke-generating mass.

15. A method of deploying a smoke-generating projectile comprising the steps of:

A) providing a unit comprised of first and second substantially cylindrical containers secured together, a smoke-generating effective mass including a deception component disposed in the first container, and a concealment component disposed in the second container;

B) igniting an injection charge disposed in the unit to launch the unit;

C) causing the deception component to be ignited to destroy all-at-once a side wall encasing the deception component, while the energy of decomposition is constrained in a radial direction to produce spontaneous smoke following a first time delay; and thereafter D) causing the concealment component to be ignited and produce persistent smoke after a further time delay, and while the first and second containers remain secured together.

16. A projectile comprising an igniter, an ignition delay device, separate containers carrying respective decomposable effective masses to be ignited at separate times following a launching of the projectile, a decomposition charge arranged to produce decomposition of an initial one of the masses that is the first of the masses to be ignited, the container which carries the initial mass including longitudinally spaced end walls and a side wall, the end walls being interconnected by a connector separate from the side wall for keeping the end walls interconnected during decomposition of the initial mass, wherein the side wall is rupturable in response to the decomposition of the initial mass while the end walls remain interconnected to constrain the discharge of energy generated by the decomposition of the initial mass to a lateral direction.

* * * * *